US012660878B2

(12) United States Patent
Soares De Oliveira

(10) Patent No.: US 12,660,878 B2
(45) Date of Patent: Jun. 23, 2026

(54) STRUCTURAL ARRANGEMENT FOR A MOTOR HELMET WITH AUTOMATED VISOR

(71) Applicants: Rodrigo Carlos Ferreira Da Silva, Vila (BR); Elimar Soares De Oliveira, Jardim Santo Andre (BR)

(72) Inventor: Elimar Soares De Oliveira, Jardim Santo Andre (BR)

(73) Assignees: Rodrigo Carlos Ferreira Da Silva, Sao Paulo (BR); Elimar Soares De Oliveira, Limeira (BR)

( * ) Notice: Subject to any disclaimer, the term of this patent is extended or adjusted under 35 U.S.C. 154(b) by 838 days.

(21) Appl. No.: 17/908,312

(22) PCT Filed: Mar. 2, 2020

(86) PCT No.: PCT/BR2020/050066

§ 371 (c)(1),
(2) Date: Aug. 31, 2022

(87) PCT Pub. No.: WO2021/174321

PCT Pub. Date: Sep. 10, 2021

(65) Prior Publication Data

US 2023/0109059 A1 Apr. 6, 2023

(51) Int. Cl.
*A42B 3/00* (2006.01)
*A42B 3/04* (2006.01)
(Continued)

(52) U.S. Cl.
CPC ..... *A42B 3/224* (2013.01); *A42B 3/044* (2013.01); *A42B 3/0493* (2013.01); *A42B 3/30* (2013.01)

(58) Field of Classification Search
CPC ..... A42B 3/224; A42B 3/044; A42B 3/0493; A42B 3/30
See application file for complete search history.

(56) References Cited

U.S. PATENT DOCUMENTS 3,066,305 A * 12/1962 Aileo ..... A61F 9/06 2/10
3,315,272 A * 4/1967 Olt ..... A42B 3/226 2/424
(Continued)

FOREIGN PATENT DOCUMENTS

CA 3168088 A1 * 9/2021 ..... A42B 3/224
CN 115515451 A * 12/2022 ..... A42B 3/224
(Continued)

OTHER PUBLICATIONS

International Search Report, National Institution of Intellectual Property, Brazil, Jul. 27, 2020.

*Primary Examiner* — Richale L Quinn
(74) *Attorney, Agent, or Firm* — Bay State IP, LLC

(57) ABSTRACT

A structural arrangement for a motorcycle helmet the protective shell of which has a recessed cavity in the upper portion forming protrusions, each protrusion having a space for the rack, and an opening; a front cavity receives a rear fairing and has a second lowered cavit with an opening between the protective hull and the internal hull, on the edges of the visors is fastened a rack with teeth actuated by a small engine with gear strategically arranged in each of the outlets of the protrusions, in the protective hull and on one end of the rack, with actuation by buttons on the helmet or devices with electronic controls by means of radio signals, installed both on the helmet and on the motorcycle or even by remote control, and power is supplied by a battery.

10 Claims, 4 Drawing Sheets

(51) Int. Cl.
*A42B 3/22* (2006.01)
*A42B 3/30* (2006.01)

(56) References Cited

U.S. PATENT DOCUMENTS

| | | | | | |
|---|---|---|---|---|---|
| 3,400,407 | A * | 9/1968 | Aileo | A42B 3/221 | 2/427 |
| 3,491,371 | A * | 1/1970 | Deangelis | A42B 3/228 | D29/107 |
| 3,601,813 | A * | 8/1971 | Aileo | A42B 3/228 | 2/6.4 |
| 3,748,657 | A * | 7/1973 | Aileo | A42B 3/226 | 2/6.4 |
| 4,028,739 | A * | 6/1977 | Bell | A42B 3/28 | 2/6.3 |
| 4,170,042 | A * | 10/1979 | Aileo | A42B 3/228 | 2/424 |
| 4,247,960 | A * | 2/1981 | Nava | A42B 3/222 | 2/10 |
| 4,297,747 | A * | 11/1981 | Nava | A42B 3/224 | 2/10 |
| 4,397,047 | A * | 8/1983 | Nava | A42B 3/222 | 2/10 |
| 4,546,498 | A * | 10/1985 | Fantin | A42B 3/224 | 2/10 |
| 4,887,320 | A * | 12/1989 | Long | A42B 3/226 | 2/424 |
| 5,416,675 | A * | 5/1995 | DeBeaux | A45C 15/06 | 362/276 |
| 6,249,918 | B1 * | 6/2001 | Lacroix | A42B 3/226 | 2/424 |
| 6,406,168 | B1 | 6/2002 | Whiting | | |
| 8,341,771 | B2 * | 1/2013 | Lee | A42B 3/226 | 2/6.3 |
| 9,775,397 | B2 * | 10/2017 | Daniels | A42B 3/225 | |
| 10,660,392 | B2 * | 5/2020 | Nimura | A42B 3/222 | |
| 11,937,659 | B2 * | 3/2024 | Lübke | A42B 3/225 | |
| 2004/0143888 | A1 * | 7/2004 | Bataille | A42B 3/228 | 2/410 |
| 2009/0064397 | A1 * | 3/2009 | Chuang | A42B 3/226 | 2/424 |
| 2011/0067158 | A1 * | 3/2011 | Lee | A42B 3/226 | 2/15 |
| 2011/0209274 | A1 * | 9/2011 | Del Rosario | A42B 3/061 | 2/10 |
| 2018/0168269 | A1 * | 6/2018 | Di Troia | A42B 3/224 | |
| 2022/0361622 | A1 * | 11/2022 | Hartlieb | A42B 3/306 | |
| 2023/0109059 | A1 * | 4/2023 | Soares De Oliveira | A42B 3/0453 | 2/424 |
| 2024/0292921 | A1 * | 9/2024 | Lieret | A42B 3/04 | |

FOREIGN PATENT DOCUMENTS

| | | | | |
|---|---|---|---|---|
| EP | 4193862 | A1 * | 6/2023 | A42B 3/281 |
| FR | 2610484 | A1 | 8/1988 | |
| GB | 2409961 | A | 7/2005 | |
| WO | WO-2014057485 | A1 * | 4/2014 | A42B 3/224 |
| WO | 2020002742 | A1 | 1/2020 | |
| WO | WO-2021174321 | A1 * | 9/2021 | A42B 3/224 |

* cited by examiner

STRUCTURAL ARRANGEMENT FOR A MOTOR HELMET WITH AUTOMATED VISOR

CROSS REFERENCE TO RELATED APPLICATION

This application is for entry into the U.S. National Phase from which priority is claimed under all applicable sections of Title 35 of the United States Code including, but not limited to, Sections 120, 363, and 365(c) to International Application No. PCT/BR2020/050066 filed on Mar. 2, 2020.

This patent of invention refers to a constructive arrangement of a motorcycle helmet, so that the hull is divided into parts with means to provide automation, closing and opening the visor, whether in helmets with one or two visors, which can be activated by buttons on the helmet itself or by devices with electronic commands through radio signals, installed both on the helmet and on the motorcycle, or even by remote control.

There is no knowledge of any helmet equipped with an automation system for the visor(s), given the difficulty of designing a hull that meets both the safety and resistance standards, as well as the spaces for the installation of electronic devices for automation as well as the power supply system.

What is intended with this new constructive Disposition is exactly to solve the problems and difficulties mentioned, thus providing a helmet with mechanisms that allow the movement of the visor(s) either in helmets with one or two visors without, however, go against the safety and strength standards of the hull, which will be further detailed in line with the attached figures, where:

Figure 1:
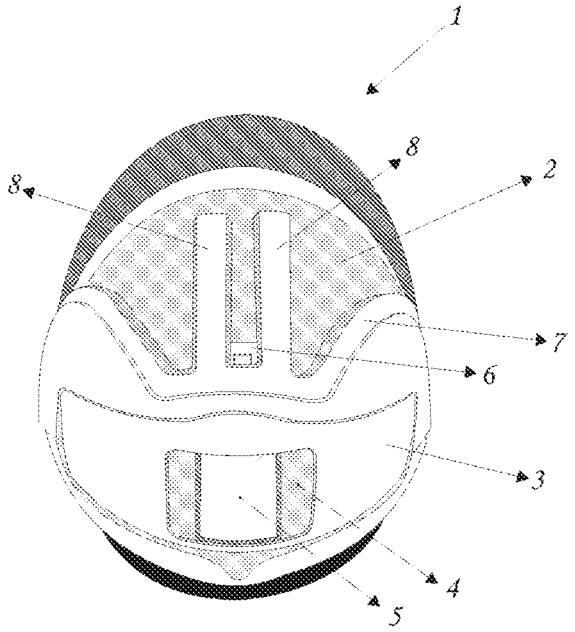
FIG. 1 shows a top view of the helmet shell.

As seen in the attached figures and, especially in the attached FIG. 1, the motorcycle helmet (1) has a constructive disposition of the protective hull (2) with a recessed cavity at the top forming reliefs (7 and 8) of so that each relief (8) has an internal space where a rack (13) will be stored and, in the front part, between the two reliefs (8) there is a small opening (6). Said protective hull (2) also has an front cavity (3), whose lowering receives a rear fairing (10) and, in the center of this front cavity (3) there is a second lowered cavity (4) with an opening between said protective hull (2) and the internal hull (5).

Figure 2:
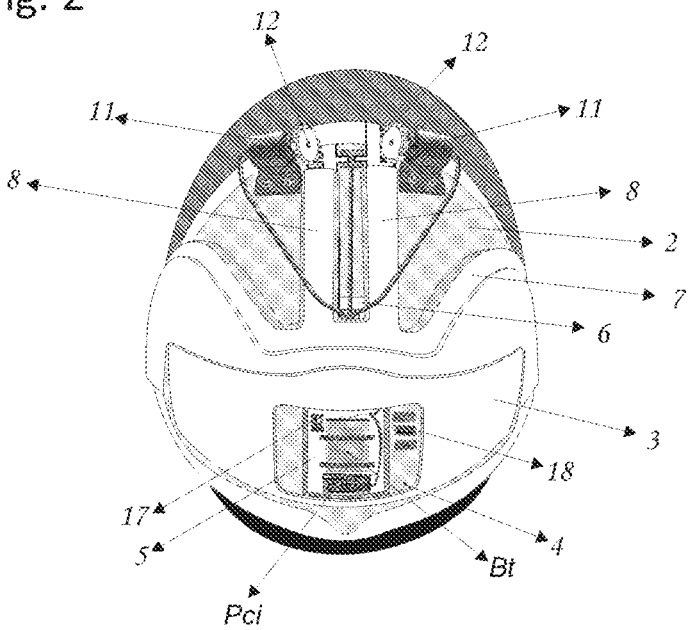
FIG. 2 shows the same view as FIG. 1, however, with the installation of electronic devices.
Figure 3:
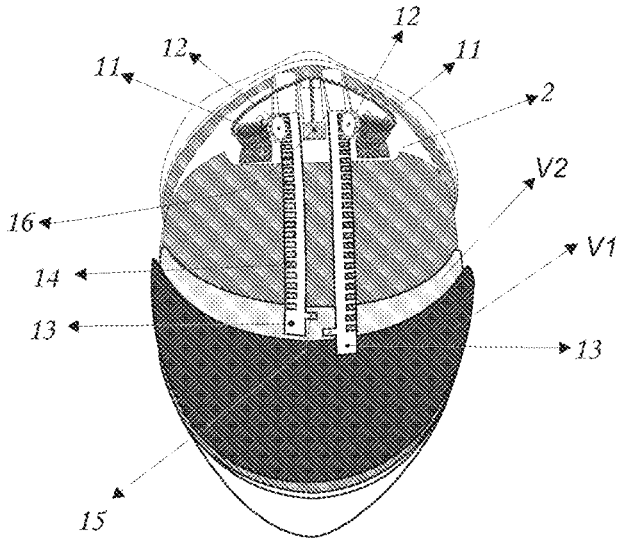
FIG. 3 shows a front view, however in perspective of the helmet shell with two visors in use position with the two racks activated. [007]
Figure 4:
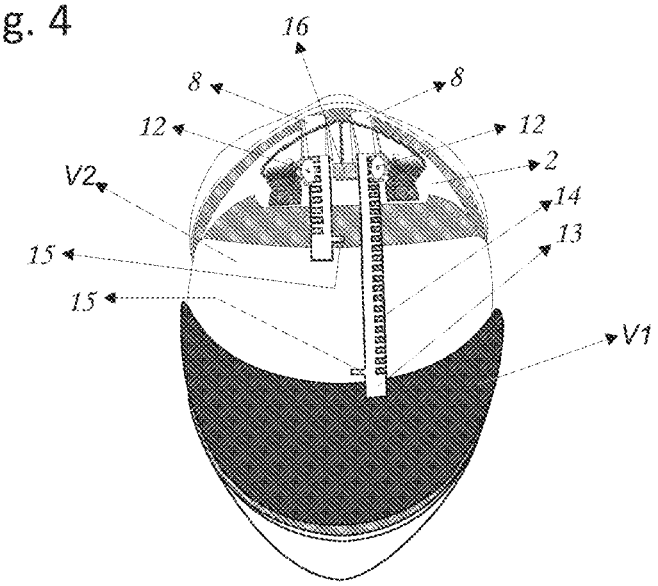
FIG. 4 shows the same as FIG. 3, however, with the lower visor rack retracted with the lower visor retracted (open) and the upper visor rack fully exposed due to said upper visor being in use position (closed).
Figure 5:
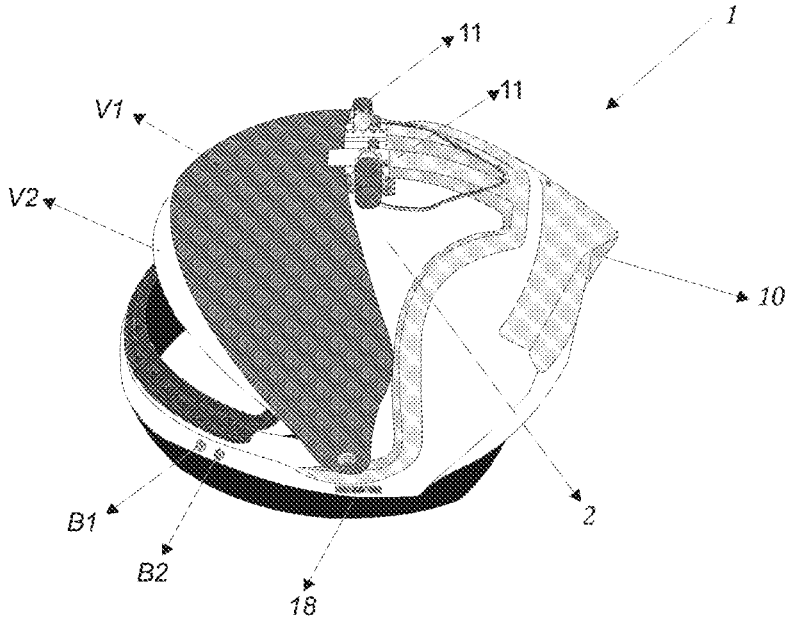
FIG. 5 shows a side view of the helmet illustrating the automation of two visors, both open, so that the racks are collected in appropriate compartments.

For the automation of the visors (V1 and V2), a small engine (11) with gear (12) is fixed on each of the reliefs (8) outlets, directly on the protection hull (2) and at one end of the rack (13) is fixed through any sticky element on the upper edge of the visor(s) (V1 and V2) so that the gear (12) is positioned directly on the teeth (14) on one of the sides of said rack (13) as seen in FIGS. 2 to 4. [013] In this sense, each rack (13) will have at both ends, ferrule (15) which will serve as a means of fixing and stroke limitation that will act in line with a stroke limiter (16) strategically installed and positioned in front of the reliefs (8) between the small engine (11) so that the racks (13) will have a limit of travel, both to open and to close the visors (V1 and V2) when the small engine (11) are activated.

Figure 6:
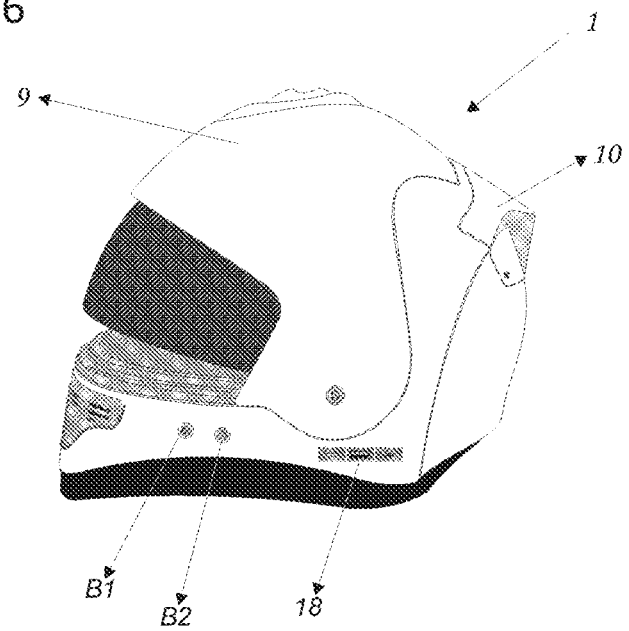
FIG. 6 shows the same view as FIG. 5, however, with an upper fairing covering the visor automation system.

The electrical supply for the small engine (11) will be through a battery (Bt) fixed on a base on the internal hull (5) inside the lowered cavit (4) in order to interconnect the small engine (11), the manual activation buttons (B1 and B2), as well as a management board (PCI) and also charging means (18) comprised of USB, mini USB and other ports, both on the outside of the helmet, as shown in FIG. 6, and on the inside as shown in FIG. 2.

Figure 7:
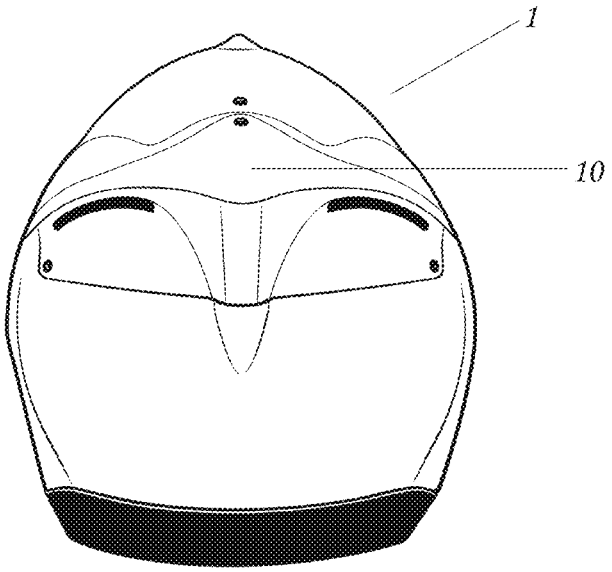
FIG. 7 shows a rear view of the helmet.

This entire system, after properly installed in the protective hull (2), will be covered at the top by an upper fairing (9), and at the rear, by a rear fairing (10), as seen in FIGS. 6 and 7, both by means of fastening by pins and/or screws.

It is important to emphasize that the great innovation of the present invention is the automation system of the visor(s) which can be adopted both for helmets with one or two visors, in helmets with visors built into the outer hull, however, as a result of the use of an electric battery (Bt) to provide power to the motor controls for activating the visors and the management board (PCI), it is also possible to add technological innovations available on the market to the helmet, such as a "chip" (17) telephony and data, as well as USB ports (18) both to carry energy to the battery (Bt), that is, to recharge it, or to power external devices, for example, to charge a cell phone of the helmet user. [017] Another great innovation of the present invention is the fact of using the management board (PCI), because through it is possible to activate the visors, through remote control and/or activation devices installed directly on the panel or handlebars of the motorcycle, allowing greater convenience and agility for the motorcyclist to trigger the opening or closing of the visor(s), or even to, for example, answer cell phone calls that can be activated through the USB (18) with reception and transmission means of voice and data, strategically installed inside the helmet.

The rear fairing (10), in addition to being used to cover the power supply system and electronic devices, is constituted by an aerodynamic design that, in addition to providing a better external look, also allows the installation of illuminated LEDs, which may be connected and managed by the card (PCI) with activation of the right and left arrow type, or brake light, all powered by the battery (Bt) and activated by the commands of the motorcycle itself, through wireless signals, such as wireless, bluetooth and others exist as a result of technological evolution.

The present patent does not intend to exhaust the possibilities of connections of electronic devices that arise as a result of the evolution of technology and, due to the fact that it brings the innovation of the battery (Bt) installed inside the safety hull, as a source of electrical power and, likewise, it does not intend to exhaust the models and design of helmets, and such invention can be applied to any model of helmet, provided that the constructive disposition of the protective hull (2) contains the recessed cavity in the upper part with reliefs (7 and 8) and internal space in the relief (8) for installation of the rack (13), in addition to the front cavity (3) with a second lowered cavit (4) for installation of electronic devices.

The invention claimed is:

1. Structural arrangement for a motorcycle helmet with automated visor for use in helmets that have built-in visor systems whose electrical supply by battery and activation through buttons on the helmet itself or by devices with electronic commands and wireless signals, remote control or bluetooth installed both on the helmet and on the motorcycle and is characterized by a protective hull (2) having a constructive arrangement that comprises a recessed cavity at a top forming two reliefs (7 and 8) and each of the two reliefs (8) has an internal space for housing a rack (13) so that, in a front, between the two reliefs (8) there is a small opening (6) that connects to a space of an internal hull (5) and, the protective hull (2) has, also, a front cavity (3), which lowers and receives a rear fairing (10) and, in a center of the front cavity (3) there is a second lower cavity (4) with an opening between the protective hull (2) and the internal hull (5).

2. The structural arrangement according to claim 1, characterized in that between an upper fairing (9) and the protective hull (2) contains a small engine (11) with gears (12) in each of the two reliefs (8).

3. The structural arrangement according to claim 1 characterized in that a small engine is fixed on an upper edge of the visor (V1 and V2) and on one end of a rack (13) through any adhesive means.

4. The structural arrangement according to claim 1, characterized in that the rack (13) contains teeth at both ends (14), at least one ferrule (15) to act as a stroke limitation in line with a stroke limiter (16) strategically installed and positioned in front of the two reliefs (8) between a small engine (11).

5. The structural arrangement according to claim 1, characterized in that a small engine contains a battery (Bt) fixed to a base on the internal hull (5) inside the second lower cavity (4) in order to interconnect a small engine (11), the buttons (B1 and B2), as well as a management board (PCI) and also charging means (18) comprised of USB, mini USB and other ports, both on an outside and on an inside of the helmet.

6. The structural arrangement according to claim 1 characterized by the fact that the visor system, after properly installed in the protective hull (2), will be covered at a top by an upper fairing (9), and at a rear, by a rear fairing (10) through fastening means by pins and/or screws.

7. The structural arrangement according to claim 1 characterized by the fact that the visor system can be adopted both for helmets with one or two visors and for helmets with built-in visors.

8. The structural arrangement according to claim 1 and, as a result of the use of a battery (Bt) to provide power for the electronic commands and small engine (11) and the management board (PCI) it is characterized by containing a chip (17) telephony and data, as well as USB ports (18) both to carry energy to the battery (Bt), that is, to recharge it, and to power external devices, for example, to charge a cell phone device of the helmet user.

9. The structural arrangement according to claim 1, it is characterized by the fact that the motorcycle helmet (1) is provided with a management board (PCI) for activating visors (V1 and V2) through remote control and/or activation of wireless devices, bluetooth and others existing as a result of technological evolution.

10. The structural arrangement according to claim 1 it is characterized by the fact that the rear fairing (10) has an aerodynamic design that, in addition to providing a better external look, also allows the installation of illuminated LEDs, which can be connected and managed by a board (PCI) with activation of a right and left arrow type, or brake light, all powered by a battery (Bt) and activated by a command of the motorcycle itself.

* * * * *